US010578321B2

(12) United States Patent
Henderson et al.

(10) Patent No.: US 10,578,321 B2
(45) Date of Patent: Mar. 3, 2020

(54) AIR CONDITIONER UNIT WITH SELECTIVE COOLING OF AN INDOOR FAN MOTOR

(71) Applicant: Haier US Appliance Solutions, Inc., Wilmington, DE (US)

(72) Inventors: Richard Dustin Henderson, LaGrange, KY (US); Richard Michael Phillips, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 99 days.

(21) Appl. No.: 15/927,166

(22) Filed: Mar. 21, 2018

(65) Prior Publication Data

US 2019/0293305 A1 Sep. 26, 2019

(51) Int. Cl.

| | |
|---|---|
| ***F24F 1/24*** | (2011.01) |
| ***F24F 11/30*** | (2018.01) |
| ***F24F 1/027*** | (2019.01) |
| ***F24F 11/50*** | (2018.01) |
| *F24F 110/12* | (2018.01) |
| *F24F 110/22* | (2018.01) |

(52) U.S. Cl.

CPC ..... *F24F 1/24* (2013.01); *F24F 1/027* (2013.01); *F24F 11/30* (2018.01); *F24F 11/50* (2018.01); *F24F 2110/12* (2018.01); *F24F 2110/22* (2018.01); *F24F 2221/20* (2013.01)

(58) Field of Classification Search

CPC ..... F24F 1/24

See application file for complete search history.

(56) References Cited

U.S. PATENT DOCUMENTS

| | | | | |
|---|---|---|---|---|
| 3,720,073 | A | 3/1973 | McCarty | |
| 4,109,708 | A * | 8/1978 | Imral | F24F 1/02 165/122 |
| 4,164,852 | A * | 8/1979 | Anzalone | H02K 16/00 310/112 |
| 5,060,720 | A * | 10/1991 | Wollaber | F04D 25/082 165/122 |
| 5,335,721 | A * | 8/1994 | Wollaber | F24F 1/027 165/122 |
| 5,523,640 | A * | 6/1996 | Sparer | B29C 35/007 165/104.33 |
| 6,568,193 | B1 * | 5/2003 | Cahill | F25B 21/02 310/52 |
| 8,733,430 | B2 * | 5/2014 | Kikuchi | B60H 1/00278 165/297 |
| 2003/0041604 | A1 * | 3/2003 | Jang | F24F 13/224 62/171 |
| 2008/0302880 | A1 * | 12/2008 | Eubank | F04D 25/082 237/28 |
| 2013/0136629 | A1 * | 5/2013 | Maier | F04D 17/122 417/366 |
| 2019/0145637 | A1 * | 5/2019 | Onuki | F24F 1/14 |

FOREIGN PATENT DOCUMENTS

KR 20020003647 A 1/2002

* cited by examiner

*Primary Examiner* — Henry T Crenshaw

(74) *Attorney, Agent, or Firm* — Dority & Manning, P.A.

(57) ABSTRACT

An air conditioner unit is provided that includes features for selectively cooling an indoor fan motor of the unit based at least in part on the outdoor temperature. Methods for selectively cooling indoor fan motors of air conditioner units are also provided.

19 Claims, 4 Drawing Sheets

AIR CONDITIONER UNIT WITH SELECTIVE COOLING OF AN INDOOR FAN MOTOR

FIELD OF THE INVENTION

The present disclosure relates generally to air conditioner units, and more particularly to methods and systems for cooling fan motors of air conditioner units.

BACKGROUND OF THE INVENTION

Air conditioner or conditioning units are conventionally utilized to adjust the temperature indoors, e.g., within structures such as dwellings and office buildings. Such units commonly include a closed refrigeration loop to heat or cool the indoor air. Typically, the indoor air is recirculated while being heated or cooled. A variety of sizes and configurations are available for such air conditioner units. For example, some units may have one portion installed indoors that is connected, by e.g., tubing carrying the refrigerant, to another portion located outdoors. These types of units are typically used for conditioning air in larger spaces.

Other types of air conditioning units are typically used to condition air within relatively smaller indoor spaces. For example, such air conditioner units may include packaged terminal units including packaged terminal air conditioner units (PTAC) and packaged terminal heat pumps (PTHP), single package vertical units (SPVU) including single package vertical air conditioners (SPVAC) and single package vertical heat pumps (SPVHP), built ins, and window units. These units may include both an indoor portion and an outdoor portion separated by a bulkhead and may be installed in windows or positioned within an opening of an exterior wall of a building.

Further, such air conditioning units typically include an indoor fan and an outdoor fan. An indoor fan motor may drive both the indoor fan and the outdoor fan or the indoor fan motor may drive the indoor fan and a separate outdoor fan motor may drive the outdoor fan. The indoor fan motor is usually mounted within the outdoor portion or compartment of the unit, e.g., so it doesn't expel heat into the cooled airstream within the indoor portion. To keep the indoor fan motor cool, in some units, a secondary fan blade is mounted to the indoor motor to flow a cooling airflow over the motor. In other units, the outdoor fan motor is run constantly to keep the indoor fan motor from overheating. As such, either additional fan components are required to be mounted on the indoor motor, thereby increasing the complexity of the indoor motor and the cost of the unit, or energy consumption is increased in order to run the outdoor fan motor to drive the outdoor fan for cooling of the indoor motor, thus increasing the cost of operating the unit.

Accordingly, improved air conditioner units and associated methods that address one or more of the challenges noted above would be useful.

BRIEF DESCRIPTION OF THE INVENTION

The present subject matter provides an air conditioner unit that includes features for selectively cooling an indoor fan motor of the unit based at least in part on the outdoor temperature. Methods for selectively cooling indoor fan motors of air conditioner units are also provided. Additional aspects and advantages of the invention will be set forth in part in the following description, may be obvious from the description, or may be learned through practice of the invention.

In one exemplary embodiment, an air conditioner unit is provided. The air conditioner unit includes a bulkhead defining an indoor portion and an outdoor portion. The air conditioner unit also includes an indoor fan disposed within the indoor portion for circulating an airflow through the indoor portion. Further, the air conditioner unit includes an indoor motor operatively coupled with and configured for driving the indoor fan, the indoor motor disposed within the outdoor portion. In addition, the air conditioner unit includes an outdoor fan disposed within the outdoor portion for circulating an airflow through the outdoor portion and an outdoor motor operatively coupled with and configured for driving the outdoor fan. Moreover, the air conditioner unit includes a temperature sensor for sensing an outdoor temperature. The air conditioner unit also includes a controller communicatively coupled with the temperature sensor and the outdoor motor, the controller configured to: receive a signal indicative of the outdoor temperature generated by the temperature sensor; determine whether the outdoor temperature exceeds a predetermined temperature threshold; and activate the outdoor motor to drive the outdoor fan to flow a cooling airflow over the indoor motor if the outdoor temperature exceeds the predetermined temperature threshold.

In some embodiments, the air conditioner unit is a packaged terminal unit, such as e.g., a packaged terminal air conditioner unit or a packaged terminal heat pump.

In some embodiments, the air conditioner unit is a single package vertical unit, such as e.g., a single package vertical air conditioner or a single package vertical heat pump.

In some embodiments, the air conditioner unit is a built in air conditioner unit.

In some embodiments, the air conditioner unit is a window unit air conditioner unit.

In accordance with another embodiment, a method of cooling an indoor fan of an air conditioner unit is provided. The air conditioner unit comprising a bulkhead defining an indoor portion and an outdoor portion, the air conditioner unit further comprising an indoor fan disposed within the indoor portion, an indoor motor disposed within the outdoor portion and operatively configured to drive the indoor fan, an outdoor fan disposed within the outdoor portion, and an outdoor motor operatively configured to drive the outdoor fan. The method includes receiving a signal indicative of an outdoor temperature. The method further includes determining whether the outdoor temperature exceeds a predetermined temperature threshold. The method also includes operating the outdoor motor at a target motor speed to drive the outdoor fan to flow a cooling airflow over the indoor motor if the outdoor temperature exceeds the predetermined temperature threshold.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION OF THE INVENTION

Figure 1:
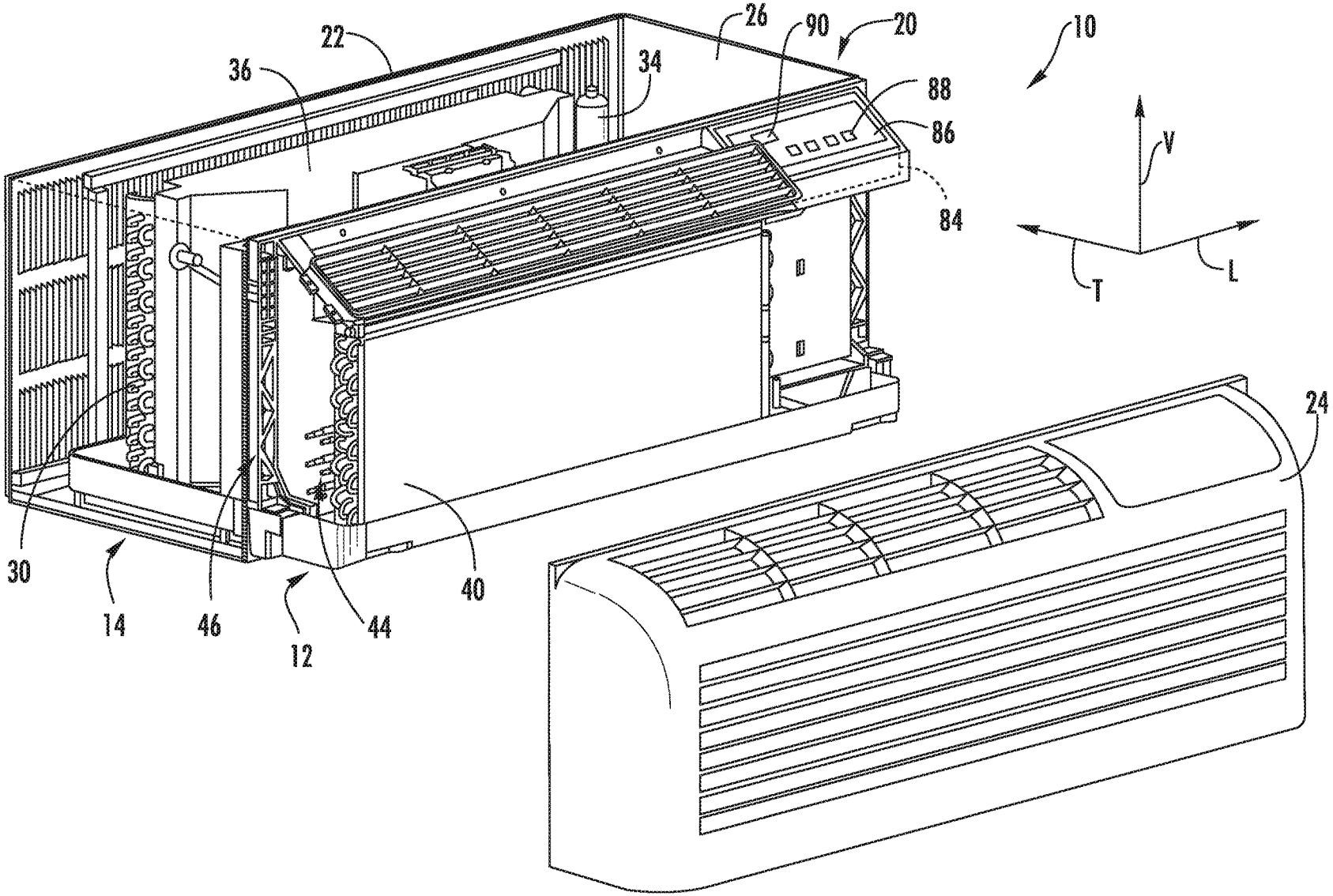
FIG. 1 provides a perspective view of an air conditioner unit, with part of an indoor portion exploded from a remainder of the air conditioner unit for illustrative purposes, in accordance with one exemplary embodiment of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 provides an air conditioner unit 10. The air conditioner unit 10 is a one-unit type air conditioner, also conventionally referred to as a room air conditioner or a packaged terminal air conditioner (PTAC). The unit 10 includes an indoor portion 12 and an outdoor portion 14, and generally defines a vertical direction V, a lateral direction L, and a transverse direction T. Each direction V, L, T is perpendicular to each other such that an orthogonal coordinate system is generally defined.

A housing 20 of the unit 10 may contain various other components of the unit 10. Housing 20 may include, for example, a rear grill 22 and a room front 24 which may be spaced apart along the transverse direction T by a wall sleeve 26. The rear grill 22 is part of or disposed within the outdoor portion 14 and the room front 24 may be part of or disposed within the indoor portion 12 of unit 10. Components of the outdoor portion 14, such as an outdoor heat exchanger 30, an outdoor fan 32 (FIGS. 2 and 3), and a compressor 34 may be housed within the wall sleeve 26. A casing 36 may additionally enclose the outdoor fan, as shown.

Indoor portion 12 may include, for example, an indoor heat exchanger 40, a indoor fan 42 (FIGS. 2 and 3), and a heating unit 44. These components may, for example, be housed behind the room front 24. Additionally, a bulkhead 46 may generally support and/or house various other components or portions thereof of the indoor portion 12, such as the indoor fan 42 and the heating unit 44. Bulkhead 46 may generally separate and define the indoor portion 12 and outdoor portion 14 of unit 10.

Figure 2:
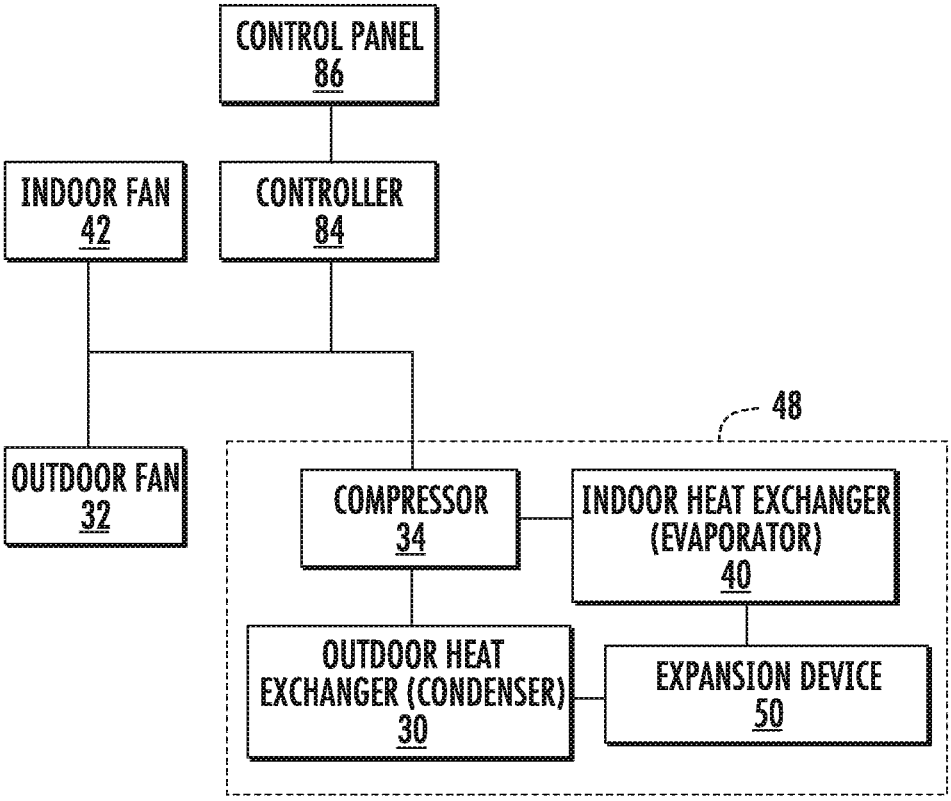
FIG. 2 provides a schematic view of a refrigeration loop of the air conditioner unit of FIG. 1.

FIG. 2 provides a schematic view of a refrigeration loop 48 or sealed system of the air conditioner unit 10. As shown in FIG. 2, outdoor and indoor heat exchangers 30, 40 may be components of refrigeration loop 48. Refrigeration loop 48 may, for example, further include compressor 34 and an expansion device 50. As illustrated, compressor 34 and expansion device 50 may be in fluid communication with outdoor heat exchanger 30 and indoor heat exchanger 40 to flow refrigerant therethrough as is generally understood by those of skill in the art. More particularly, refrigeration loop 48 may include various lines for flowing refrigerant between the various components of refrigeration loop 48, thus providing fluid communication between the components of refrigeration loop 48. Refrigerant may thus flow through such lines from indoor heat exchanger 40 to compressor 34, from compressor 34 to outdoor heat exchanger 30, from outdoor heat exchanger 30 to expansion device 50, and from expansion device 50 to indoor heat exchanger 40. The refrigerant may generally undergo phase changes associated with a refrigeration cycle as it flows to and through these various components, as is generally understood. One suitable refrigerant for use in refrigeration loop 48 is 1,1,1,2-Tetrafluoroethane, also known as R-134A, although it should be understood that the present disclosure is not limited to such example and rather that any suitable refrigerant may be utilized.

As is understood in the art, refrigeration loop 48 may be alternately be operated as a refrigeration assembly (and thus perform a refrigeration cycle) or a heat pump (and thus perform a heat pump cycle). As shown in FIG. 2, when refrigeration loop 48 is operating in a cooling mode and thus performs a refrigeration cycle, the indoor heat exchanger 40 acts as an evaporator and the outdoor heat exchanger 30 acts as a condenser. Alternatively, when the assembly is operating in a heating mode and thus performs a heat pump cycle, the indoor heat exchanger 40 acts as a condenser and the outdoor heat exchanger 30 acts as an evaporator. The outdoor and indoor heat exchangers 30, 40 may each include coils through which a refrigerant may flow for heat exchange purposes, as is generally understood.

According to an example embodiment, compressor 34 may be a variable speed compressor. In this regard, compressor 34 may be operated at various speeds depending on the current air conditioning needs of the room and the demand from refrigeration loop 48. For example, according to an exemplary embodiment, compressor 34 may be configured to operate at any speed between a minimum speed, e.g., 1500 revolutions per minute (RPM), to a maximum rated speed, e.g., 3500 RPM. Notably, use of variable speed compressor 34 enables efficient operation of refrigeration loop 48 (and thus air conditioner unit 10), minimizes unnecessary noise when compressor 34 does not need to operate at full speed, and ensures a comfortable environment within the room.

In exemplary embodiments as illustrated, expansion device 50 may be disposed in the outdoor portion 14 (FIG. 1) between the indoor heat exchanger 40 and the outdoor heat exchanger 30. According to the exemplary embodiment, expansion device 50 may be an electronic expansion valve that enables controlled expansion of refrigerant, as is known in the art. More specifically, electronic expansion device 50 may be configured to precisely control the expansion of the refrigerant to maintain, for example, a desired temperature differential of the refrigerant across the indoor heat exchanger 40. In other words, electronic expansion device 50 throttles the flow of refrigerant based on the reaction of the temperature differential across indoor heat exchanger 40 or the amount of superheat temperature differential, thereby ensuring that the refrigerant is in the gaseous state entering compressor 34. According to alternative embodiments, expansion device 50 may be a capillary tube or another suitable expansion device configured for use in a thermodynamic cycle.

In some embodiments, heating unit 44 includes one or more heater banks. Each heater bank may be operated as desired to produce heat. Any suitable number of heater banks may be utilized, such as e.g., three (3) heater banks. Each heater bank may further include at least one heater coil or coil pass, such as e.g., two (2) heater coils or coil passes. Alternatively, other suitable heating elements may be utilized.

The operation of air conditioner unit 10 including compressor 34 (and thus refrigeration loop 48 generally) indoor fan 42, outdoor fan 32, heating unit 44, expansion device 50, and other components of refrigeration loop 48 may be controlled by a processing device such as a controller 84 (FIGS. 1 and 2). Controller 84 may be communicatively coupled with such components of the air conditioner unit 10 as shown in FIG. 2, e.g., via a suitable wired or wireless connection. In some embodiments, the controller 84 may include a memory and one or more processing devices such as microprocessors, CPUs or the like, such as general or special purpose microprocessors operable to execute programming instructions or micro-control code associated with operation of unit 10. The memory may represent random access memory such as DRAM, or read only memory such as ROM or FLASH. In one embodiment, the processor executes programming instructions stored in memory. The memory may be a separate component from the processor or may be included onboard within the processor.

As depicted in FIG. 1, unit 10 may additionally include a control panel 86 and one or more user inputs 88, which may be included in control panel 86. The user inputs 88 may be in communication with the controller 84. A user of the unit 10 may interact with the user inputs 88 to operate the unit 10, and user commands may be transmitted between the user inputs 88 and controller 84 to facilitate operation of the unit 10 based on such user commands. A display 90 may additionally be provided in the control panel 86, and may be in communication with the controller 84. Display 90 may, for example be a touchscreen or other text-readable display screen, or alternatively may simply be a light that can be activated and deactivated as required to provide an indication of, for example, an event or setting for the unit 10.

Figure 3:
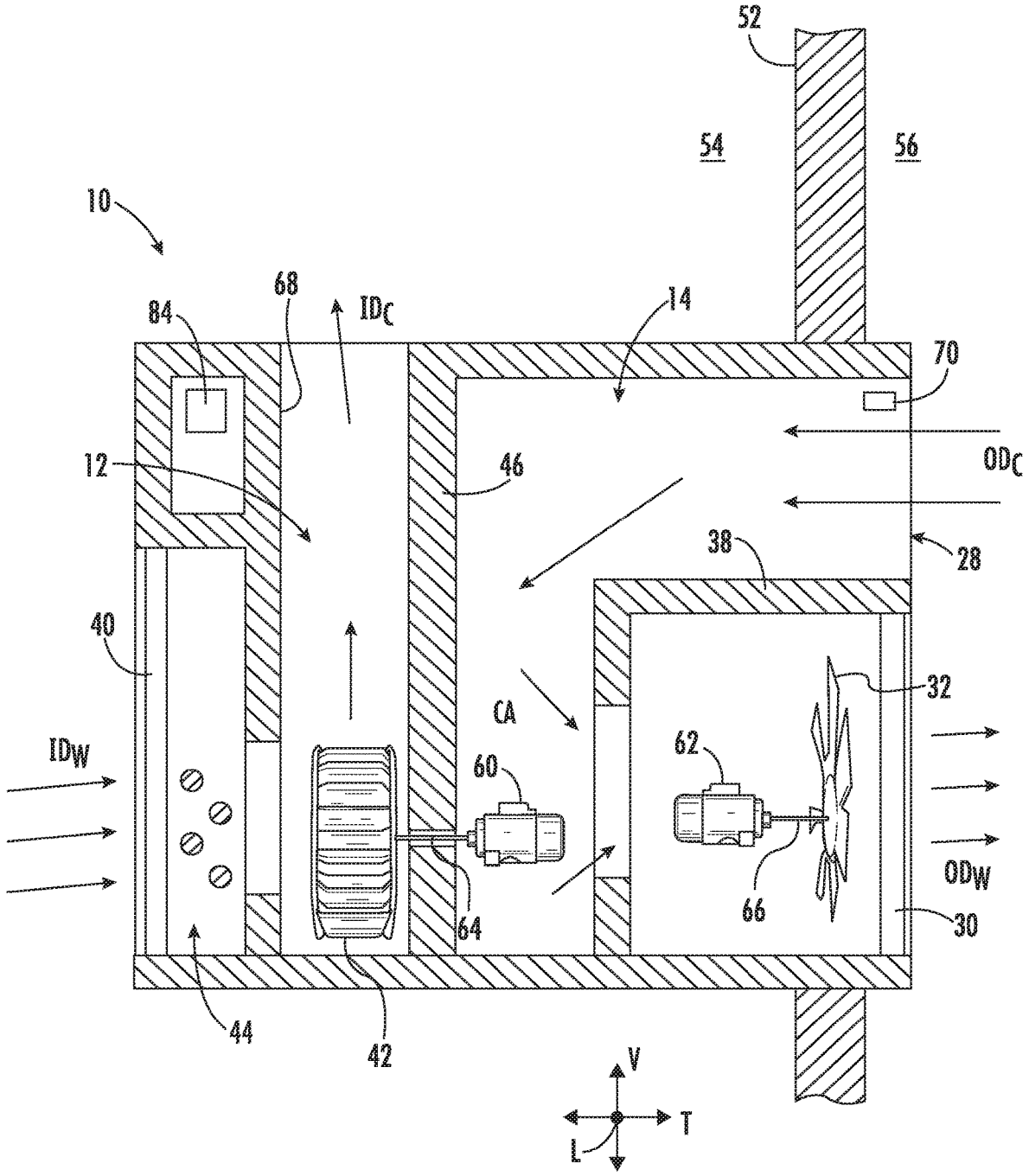
FIG. 3 provides a schematic view of the air conditioner unit of FIG. 1.

FIG. 3 provides a schematic view of the air conditioner unit 10 of FIG. 1. As shown in FIG. 3, unit 10 is positioned within an opening defined by an exterior wall 52 of a structure. The exterior wall 52 defines an interior 54 and an exterior 56. As noted above, unit 10 may run a refrigeration cycle or heat pump cycle to condition the air within interior 54 depending on whether it is desired to cool or heat interior 54.

Bulkhead 46 defines indoor portion 12 and outdoor portion 14 of unit 10. As depicted, indoor fan 42 is disposed within the indoor portion 12 of unit 10 for circulating an airflow through the indoor portion 12. For this exemplary embodiment, indoor fan 42 is a centrifugal blower fan as shown in FIG. 3. However, in alternative exemplary embodiments, indoor fan 42 may be other suitable fan types. An indoor motor 60 is operatively coupled with indoor fan 42, e.g., by an output shaft 64 and various other mechanical features as will be understood by those in the art. Indoor motor 60 is configured to drive indoor fan 42 during operation of unit 10. Notably, indoor motor 60 is disposed within the outdoor portion 14 of unit 10. Thus, output shaft 64 extends through an opening in bulkhead 46 to mechanically couple indoor fan 42 with indoor motor 60. As indoor motor 60 is positioned in the outdoor portion 14 of unit 10, indoor motor 60 does not expel heat into the cooled airflow within the indoor portion 12 during a refrigeration cycle, among other reasons. Indoor fan motor 60 may be any suitable type of motor, such as e.g., an induction motor. In alternative exemplary embodiments, indoor motor 60 may be other suitable types of motors.

As further shown in FIG. 3, outdoor fan 32 is disposed within the outdoor portion 14 for circulating an airflow through the outdoor portion 14. More particularly, outdoor fan 32 is disposed within a fan shroud 38 within outdoor portion 14. Outdoor fan 32 is an axial fan in this exemplary embodiment. In alternative exemplary embodiments, indoor fan 42 may be other suitable fan types. An outdoor motor 62 is operatively coupled with outdoor fan 32, e.g., by an output shaft 66 and other various mechanical features. Outdoor motor 62 is configured to drive the outdoor fan 32 in some instances during operation of unit 10. Outdoor motor 62 is disposed within the outdoor portion 14. In addition, as depicted, unit 10 includes a temperature sensor 70 disposed within the outdoor portion 14. Temperature sensor 70 is operatively configured for sensing the air temperature within outdoor portion 14 proximate its position. For this exemplary embodiment, temperature sensor 70 is mounted at or proximate an outdoor portion inlet 28 defined by housing 20 of unit 10. In alternative exemplary embodiments, temperature sensor 70 is mounted at or proximate the outer casing or housing of indoor motor 60.

In some embodiments, outdoor fan 32 and indoor fan 42 are variable speed fans. For example, referring to indoor fan 42, indoor motor 60 may be configured to rotate the blades of indoor fan 42 at different rotational speeds, thereby generating different air flow rates through indoor portion 12 of unit 10. Likewise, referring to outdoor fan 32, outdoor motor 62 may be configured to rotate the blades of outdoor fan 32 at different rotational speeds, thereby generating different air flow rates through outdoor portion 14 of unit 10. It may be desirable to operate fans 32, 42 at less than their maximum rated speed to ensure safe and proper operation of refrigeration loop 48, e.g., to reduce noise when full speed operation is not needed. In addition, according to alternative embodiments, fans 32, 42 may be operated to urge make-up air into the room. Further, in some exemplary embodiments, outdoor fan 32 is a constant or single speed fan switchable between an "on" and "off" mode of operation. As such, in such embodiments, outdoor motor 62 may be a single speed motor.

With reference still to FIG. 3, an exemplary manner in which air may be conditioned by unit 10 during a refrigeration cycle will now be described. As shown, warm indoor air, denoted $ID_w$, is drawn into unit 10 from interior 54. During a refrigeration cycle, indoor fan 42 may operate as an evaporator fan in refrigeration loop 48 (FIG. 2). That is, as indoor fan 42 draws in the warm indoor air $ID_w$ from interior 54, the warm indoor air $ID_W$ is drawn across indoor heat exchanger 40 causing the refrigerant to evaporate. As a result, the warm indoor air $ID_W$ is cooled as will be understood by those of skill in the art. Indoor fan 42 blows the now cooled indoor air $ID_C$ through a supply duct 68 and returns the cool indoor air $ID_C$ to interior 54. In outdoor portion 14, relatively cool outdoor air $OD_C$ is drawn into the unit 10 through outdoor portion inlet 28 and is drawn ultimately across outdoor heat exchanger 30 and is expelled out of unit 10 to exterior 56 as warm outdoor air $OD_W$. As the air is drawn across the outdoor heat exchanger 30, the compressed-vapor refrigerant is liquidized and the heat from such process is expelled to exterior 56. The cooled refrigerant then flows downstream to expansion device 50 (FIG. 3) and ultimately returns to outdoor heat exchanger 30 as will be appreciated by those of skill in the art. Notably, by drawing air through outdoor portion 14, the airflow acts as a cooling airflow CA to cool indoor motor 60 and outdoor motor 62 through convection heat transfer.

In some instances, indoor motor 60 may be subjected to high temperatures during operation of unit 10. In accordance with exemplary aspects of the present disclosure, to prevent overheating and for cooling of indoor motor 60, outdoor motor 62 may be controlled to drive outdoor fan 32 to flow a cooling airflow over indoor motor 60. An exemplary method for cooling indoor motor 60 is provided below.

Figure 4:
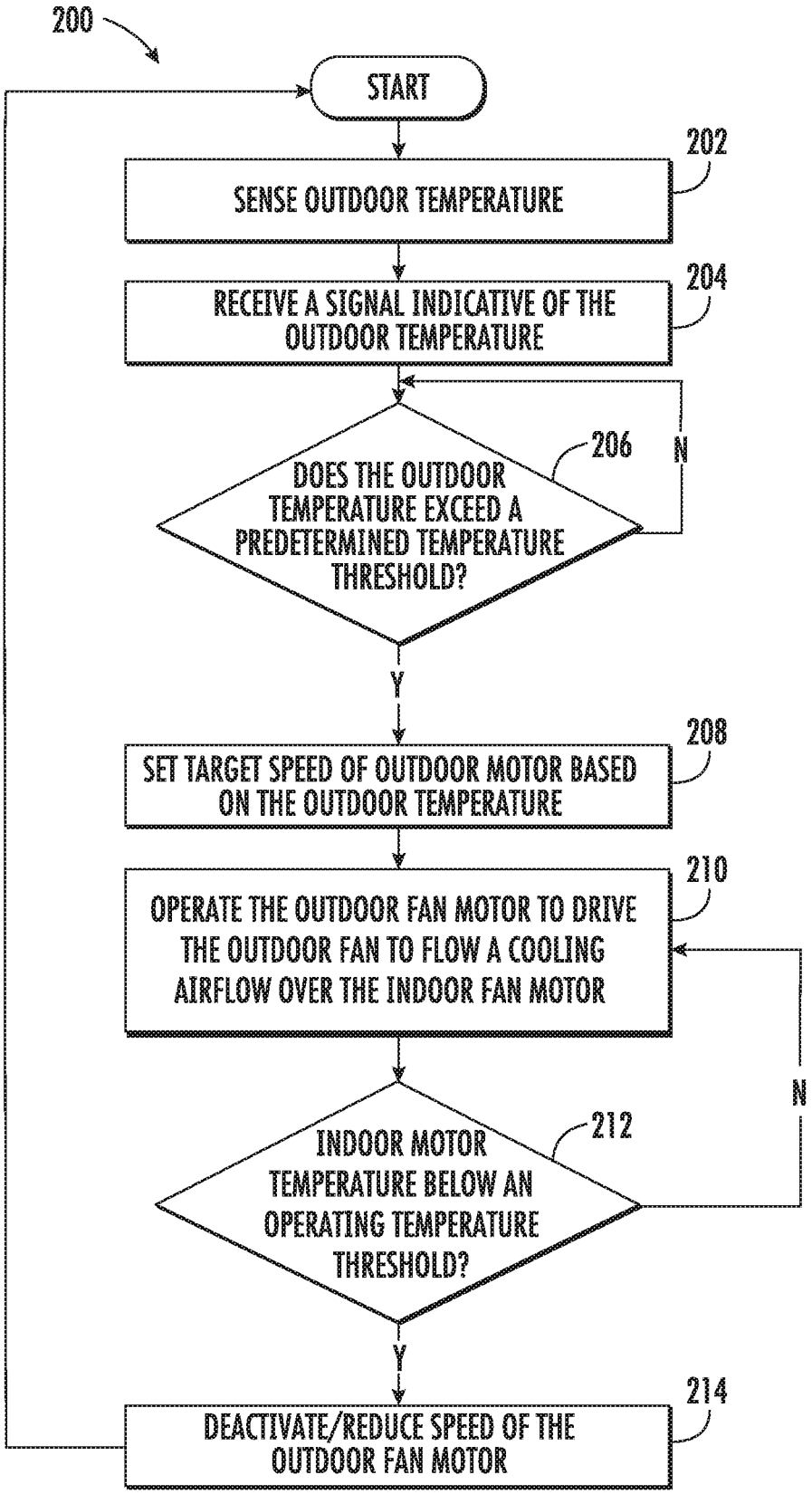
FIG. 4 provides a flow chart depicting an exemplary method for cooling an indoor motor of an air conditioning unit in accordance with one exemplary embodiment of the present disclosure.

FIG. 4 provides a flow chart of an exemplary method (200) for cooling an indoor motor of an air conditioning unit in accordance with exemplary embodiments of the present disclosure. For instance, method (200) may be used to cool indoor motor 60 of air conditioner unit 10 of FIGS. 1 through 3. Accordingly to provide context to method (200), reference numerals used to describe features of air conditioner unit 10 will be utilized below. Although the discussion below refers to the exemplary method (200) of operating air conditioner unit 10, one skilled in the art will appreciate that the exemplary method (200) is applicable to the operation of a variety of other air conditioning units having different configurations. In exemplary implementations of method (200), controller 84 may perform some or all of method (200).

At (202), method (200) includes sensing, by the temperature sensor, an outdoor temperature. For instance, as one example, temperature sensor 70 disposed within outdoor portion 14 and positioned at or proximate outdoor portion inlet 28 may sense the temperature of the air within outdoor portion 14. As another example, temperature sensor 70 disposed within outdoor portion 14 and mounted to indoor motor 60 may sense the temperature of the air within outdoor portion 14. As yet another example, temperature sensor 70 disposed may be disposed along an exterior facing surface of housing 20 of unit 10 and may sense the temperature of the air of the exterior 56.

At (204), method (200) includes receiving a signal indicative of the outdoor temperature. For instance, once the outdoor temperature is sensed at (202) by temperature sensor 70, an output signal generated by temperature sensor 70 indicative of the outdoor temperature is routed to controller 84, e.g., via a wired or wireless connection. Controller 84 may then process the signal so that further decisions can be made as discussed further below. Temperature sensor 70 may constantly monitor the outdoor temperature at (302), and accordingly, controller 84 may receive output signals generated by temperature sensor 70 continuously at a predetermined interval or time step at (304), such as e.g., every tenth of a second, every half second, every second, every five (5) seconds, etc. Controller 84 can receive the output signals directly or indirectly from temperature sensor 70.

At (206), method (200) includes determining whether the outdoor temperature exceeds a predetermined temperature threshold. For example, suppose the predetermined temperature threshold is ninety degrees Fahrenheit (90° F.) and that the sensed outdoor temperature is ninety-five degrees Fahrenheit (95° F.). In such example, the outdoor temperature would exceed the predetermined temperature threshold as ninety-five degrees Fahrenheit (95° F.) is a higher temperature than ninety degrees Fahrenheit (90° F.). As another example, suppose the predetermined temperature threshold is ninety degrees Fahrenheit (90° F.) and that the sensed outdoor temperature is eighty-five degrees Fahrenheit (85° F.). In such example, the outdoor temperature would not exceed the predetermined temperature threshold as eighty-five degrees Fahrenheit (85° F.) is a lower temperature than ninety degrees Fahrenheit (90° F.). If the outdoor temperature exceeds the predetermined temperature threshold, then method (200) proceeds to (208) so that outdoor fan 32 may ultimately be activated and operated to provide a cooling airflow over or across indoor fan motor 60 for cooling of indoor fan motor 60. If, however, the outdoor temperature does not exceed the predetermined temperature threshold, then method (200) loops back upon itself to continue monitoring whether new output signals exceed the predetermined temperature threshold at (206).

At (208), method (200) includes setting a target motor speed of the outdoor motor based at least in part on the outdoor temperature so that the outdoor fan reaches a target fan speed. For instance, the control logic of controller 84 can set the actual speed of outdoor motor 62 or some other parameter that effectively controls the speed of outdoor motor 62, such as e.g., the power level of the motor or the torque output of the motor.

In some implementations, the outdoor motor 62 is an adjustable or variable speed motor that allows outdoor motor 62 to operate on an infinite number of torque-speed curves. In such implementations, setting the target motor speed of the outdoor motor 62 includes correlating the outdoor temperature with a target motor speed table. For instance, the target motor speed table may be a lookup table that correlates outdoor temperatures with target motor speeds that are ideal for cooling the indoor fan motor 60 based on the sensed outdoor temperature. Thus, in such implementations, the target motor speed of outdoor motor 62 is set in accordance with the motor speed that correlates with the sensed outdoor temperature.

In some implementations, the outdoor motor 62 is an adjustable or variable speed motor that allows outdoor motor 62 to operate at a plurality of speed settings. For example, the speed settings might include a slow speed setting, a medium speed setting, and a high speed setting. In such implementations, the plurality of speed settings of outdoor motor 62 include at least three speed settings. However, in other implementations, outdoor motor 62 may include two (2) speed settings, e.g., high and low speed settings, or more than three (3) speed settings. In implementations where outdoor motor 62 is an adjustable or variable speed motor that allows outdoor motor 62 to operate at a plurality of speed settings, setting the target motor speed of the outdoor motor 62 includes setting the target motor speed to one of the plurality of speed settings of outdoor motor 62.

As one example, suppose outdoor motor 62 includes three speed settings, including a low, medium, and high speed setting. Further suppose that the control logic of controller 84 includes a transfer function with the following conditions: if the outdoor temperature is greater than eighty degrees Fahrenheit (80° F.), then set target motor speed to the low speed setting; if the outdoor temperature is greater than ninety-five degrees Fahrenheit (95° F.), then set target motor speed to the medium speed setting; and if the outdoor temperature is greater than one hundred five degrees Fahrenheit (105° F.), then set target motor speed to the high speed setting. Thus, in such an example, depending on the outdoor temperature, the target motor speed of outdoor fan 32 is set by the transfer function and its conditional expressions. For instance, if the outdoor temperature is eighty-seven degrees Fahrenheit (87° F.), then the target motor speed is set to the low speed setting as eighty-seven degrees Fahrenheit (87°

F.) is a higher temperature than eighty degrees Fahrenheit (80° F.) but not greater than ninety-five degrees Fahrenheit (95° F.) (i.e., the temperature threshold to enter the next highest temperature setting.

In some implementations, outdoor fan motor 62 is a single speed motor. Accordingly, in such implementations, if the outdoor temperature exceeds the predetermined temperature threshold as determined at (206), then at (208) the outdoor motor 62 is set to its only speed.

At (210), after determining that the outdoor temperature exceeds the predetermined temperature threshold at (206) and setting the target motor speed of the outdoor motor at (208), method (200) includes operating the outdoor motor to drive the outdoor fan to flow a cooling airflow over the indoor motor. In this way, indoor fan motor 60 may be cooled and prevented from overheating. Controller 84 may activate outdoor motor 62 to begin operation, or alternatively, outdoor fan motor 62 may already be in operation and controller 84 may activate outdoor motor 62 to increase its target motor speed. As one example, controller 84 may send a control signal to outdoor motor 62 with activation instructions as well as other information, such as e.g., the speed setting, duty cycle run time, etc.

With reference to FIG. 3, once outdoor motor 62 is activated and operating, output shaft 66 of outdoor motor 62 drives outdoor fan 32. That is, rotation of output shaft 66 in turn drives the blades of outdoor fan 32 about the axial direction, which in this example is the transverse direction T. The rotation of the blades of outdoor fan 32 draws the relatively cool outdoor air $OD_C$ into unit 10 through outdoor portion inlet 28. The cool outdoor air $OD_C$ flows through outdoor portion 14 of unit 10 where the cool outdoor air $OD_C$ or cooling airflow CA flows across or over indoor fan motor 60 as shown in FIG. 3. This cooling airflow CA, which is cool relative to the temperature about indoor fan motor 60 cools the indoor fan motor 60 by convection heat transfer. For example, the cooling airflow may be ninety degrees Fahrenheit (90° F.) and the temperature about indoor fan motor 60 may be one hundred fifty degrees Fahrenheit (150° F.). After being drawn over the indoor fan motor 60, the cooling airflow CA, now warmer, is drawn toward outdoor fan 32 where the air is eventually expelled to exterior 56 as warm outdoor air $OD_W$. By flowing a cooling airflow over the indoor fan motor 60 based at least in part on the outdoor temperature, the outdoor fan need not be operated at all times when the indoor fan motor 60 is operated. For instance, advantageously, in a fan only mode of unit 10, the outdoor motor and fan are only run as necessary, e.g., when the outdoor temperature exceeds the temperature threshold. This may conserve energy and reduce the noise level of the unit 10, for example.

At (212), with reference again to FIG. 3, in some implementations, once the outdoor fan motor 62 is activated and operating, method (200) includes determining whether an indoor fan motor temperature is below an operating temperature threshold. The operating temperature threshold may be set as a temperature at which the indoor fan motor 60 is safe to operate within a degree of safety that the motor will not overheat. If the indoor motor temperature is below the operating temperature threshold, it is determined that the temperature in or about indoor fan motor 60 is within a safe operating temperature and not likely to overheat, and accordingly, method (200) proceeds to (214). If, however, the indoor motor temperature is not below the operating temperature threshold, then method (200) loops back to (210) to continue operating outdoor fan motor 62 to drive the outdoor fan 32. Accordingly, in such implementations, the outdoor motor 62 is operated to drive the outdoor fan 32 until the indoor fan motor temperature is below the operating temperature threshold.

In some implementations, prior to determining whether an indoor fan motor temperature is below an operating temperature threshold at (212), the method (200) including receiving a signal indicative of the indoor fan motor temperature. Temperature sensor 70 or some other sensor may sense the indoor fan motor temperature and the generated signal may be routed to controller 84 so that the determination may be made at (212). As one example, the indoor fan motor temperature may be an internal temperature of indoor fan motor 60 sensed by a temperature sensor within indoor fan motor 60. Such signal may be routed to controller 84. As another example, the indoor fan motor temperature may be a temperature immediately proximate the outer casing of the indoor fan motor 60, e.g., sensed by temperature sensor 70 mounted thereon or proximate to the outer casing of indoor fan motor 60. Such signal may be routed to controller 84. As yet another example, temperature sensor 70 disposed within outdoor portion 14 or along an exterior facing surface of exterior wall 52 may sense the outdoor temperature. Such signal may be routed to controller 84. Upon receipt of the signal, controller 84 may correlated the outdoor temperature with an indoor fan motor temperature, e.g., by utilizing a lookup table. In addition to using the outdoor temperature to predict the indoor motor temperature, at least one of various other parameters may be used in predicting the motor temperature of the indoor motor 60, such as e.g., the current run time of the indoor motor 60, the humidity within outdoor portion 14 of unit 10, etc. As such, in some implementations, unit 10 may include a humidity sensor to sense the humidity of the air of exterior 56, or alternatively, the humidity sensor may sense the humidity within outdoor portion 14 of unit 10. In such implementations, the humidity sensor may be disposed within the outdoor portion 14 of unit 10. Further, in some implementations, controller 84 may be communicatively coupled with indoor motor 60 and may track the run time of indoor motor 60, e.g., with a timer communicatively coupled with controller 84.

In some alternative implementations, once the outdoor fan motor 62 is activated and operating, method (200) includes determining whether a predetermined run time of the outdoor fan motor has elapsed. If the predetermined run time of the outdoor fan motor has elapsed, method (200) proceeds to (214). If, however, the predetermined run time of the outdoor fan motor has not elapsed, then method (200) loops back to (210) to continue operating outdoor fan motor 62 to drive the outdoor fan 32. Accordingly, in such implementations, the outdoor motor 62 is operated to drive the outdoor fan 32 until the predetermined run time of the outdoor motor 62 has elapsed. In this way, the outdoor fan motor 62 does not itself overheat or run continuously.

In yet some further implementations, once the outdoor fan motor 62 is activated and operating at (210), method (200) includes determining whether an indoor fan motor temperature is below an operating temperature threshold and determining whether a predetermined run time of the outdoor fan motor has elapsed. If the indoor motor temperature is below the operating temperature threshold or if the predetermined run time of the outdoor fan motor has elapsed, method (200) proceeds to (214). In this way, outdoor fan motor 62 may be deactivated or the speed of the motor reduced at (214) if either the indoor fan motor temperature is a safe operating temperature or if the outdoor fan motor 62 has operated for its predetermined run time.

At (214), if the indoor motor temperature is below the operating temperature threshold at (212) or the predetermined run time of the outdoor motor has elapsed, method (200) includes deactivating or reducing the target motor speed of the outdoor fan motor. As one example, if air conditioner unit 10 is operating in a fan only mode (i.e., indoor fan 42 is running without the sealed system of unit 10), it may be desirable to deactivate the outdoor fan motor 62 if the indoor motor temperature is below the operating temperature threshold. This may reduce the noise level of the unit and save energy. As another example, if unit 10 is running a refrigeration cycle and outdoor fan 32 is necessary for drawing air over the compressed-vaporized refrigerant passing through outdoor heat exchanger 30 to expel the heat to exterior 56, then it may be desirable to keep outdoor fan motor 62 in operation to continue driving outdoor fan 32. However, the target motor speed used to cool indoor fan motor 60 may be a speed that is greater than necessary to achieve proper liquefaction of the compressed-vaporized refrigerant passing through outdoor heat exchanger 30, and accordingly, the speed of the outdoor fan motor 62 can be reduced to a more ideal target speed. In this way, the noise level of the unit 10 may be reduced and energy consumption can be reduced. Stated differently, after ramping the target speed of the outdoor fan motor 62 to drive the outdoor fan 32 to cool the indoor fan motor 60, the target speed may be ramped down at (214) to conserve energy and reduce noised emanating from unit 10. As shown in FIG. 4, after deactivating or reducing the outdoor fan motor 62 speed at (214), method (200) repeats so that monitoring of the indoor fan motor 60 may continue and selective cooling thereof can be achieved.

The construction of unit 10 and the method (200) described above provide a means for selectively cooling an indoor fan motor of an air conditioner unit based at least in part on the outdoor temperature. By selectively cooling an indoor fan motor of an air conditioner unit based at least in part on the outdoor temperature, the outdoor fan motor need not drive the outdoor fan at all times. In this way, energy may be conserved and noise levels may be reduced. Further, complex motor designs for indoor fans are generally not required, such as e.g., an indoor fan motor having a secondary cooling fan attached thereto. In addition, as noted above, the target motor speed of the outdoor fan motor (and in turn the outdoor fan) may be ramped up for cooling the indoor fan and ramped down after the indoor fan is sufficiently cooled. In this way, energy may be conserved and noise levels of the unit may be reduced.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An air conditioner unit, comprising:

a bulkhead defining an indoor portion and an outdoor portion;

an indoor fan disposed within the indoor portion for circulating an airflow through the indoor portion;

an indoor motor operatively coupled with and configured for driving the indoor fan, the indoor motor disposed within the outdoor portion;

an outdoor fan disposed within the outdoor portion for circulating an airflow through the outdoor portion;

an outdoor motor operatively coupled with and configured for driving the outdoor fan;

a temperature sensor for sensing an outdoor temperature;

a controller communicatively coupled with the temperature sensor and the outdoor motor, the controller configured to:

receive a signal indicative of the outdoor temperature generated by the temperature sensor;

determine whether the outdoor temperature exceeds a predetermined temperature threshold; and activate the outdoor motor to drive the outdoor fan to flow a cooling airflow over the indoor motor if the outdoor temperature exceeds the predetermined temperature threshold.

2. The air conditioner unit of claim 1, wherein the temperature sensor is mounted on or proximate the indoor motor.

3. The air conditioner unit of claim 1, further comprising:

a housing defining an outdoor portion inlet of the outdoor portion, wherein the temperature sensor is mounted at or proximate the outdoor portion inlet.

4. The air conditioner unit of claim 1, wherein the outdoor motor is a variable speed motor, and wherein the controller is further configured to:

set a target motor speed of the outdoor motor based at least in part on the outdoor temperature, wherein when the controller sets the target motor speed of the outdoor motor, the controller is configured to: correlate the outdoor temperature of the indoor motor with a target motor speed table.

5. The air conditioner unit of claim 4, wherein when the controller sets the target motor speed, the target motor speed is set based at least in part on a current run time of the indoor motor.

6. The air conditioner unit of claim 4, wherein when the controller sets the target motor speed, the target motor speed is set based at least in part on a humidity within the outdoor portion of the air conditioner unit.

7. The air conditioner unit of claim 1, wherein the outdoor fan motor is a single speed motor.

8. The air conditioner unit of claim 1, wherein the air conditioner unit is a packaged terminal air conditioner.

9. The air conditioner unit of claim 1, wherein the indoor fan is a centrifugal blower fan.

10. A method of cooling an indoor fan of an air conditioner unit, the air conditioner unit comprising a bulkhead defining an indoor portion and an outdoor portion, the indoor fan disposed within the indoor portion, the air conditioner unit further comprising an indoor motor disposed within the outdoor portion and operatively configured to drive the indoor fan, an outdoor fan disposed within the outdoor portion, and an outdoor motor operatively configured to drive the outdoor fan, the method comprising:

receiving a signal indicative of an outdoor temperature;

determining whether the outdoor temperature exceeds a predetermined temperature threshold; and operating the outdoor motor at a target motor speed to drive the outdoor fan to flow a cooling airflow over the indoor motor if the outdoor temperature exceeds the predetermined temperature threshold.

11. The method of claim 10, wherein after operating, the method further comprises:

determining whether a motor temperature is less than an operating temperature threshold.

12. The method of claim 11, wherein if the motor temperature is less than the operating temperature threshold, the method further comprises:

deactivating the outdoor motor.

13. The method of claim 11, wherein if the motor temperature is less than the operating temperature threshold, the method further comprises:

reducing the target motor speed of the outdoor motor.

14. The method of claim 11, wherein the air conditioner unit further comprises a temperature sensor disposed within the outdoor portion, and wherein the method further comprises:

predicting the motor temperature of the indoor motor based at least in part on the outdoor temperature and at least one of a run time of the indoor motor and a humidity within the outdoor portion of the air conditioner unit.

15. The method of claim 10, wherein the outdoor motor is operated to drive the outdoor fan until a predetermined run time of the outdoor motor has elapsed.

16. The method of claim 10, further comprising:

setting the target motor speed of the outdoor motor based at least in part on the outdoor temperature.

17. The method of claim 16, wherein the outdoor motor is a variable speed motor, and wherein setting the target motor speed of the outdoor motor comprises correlating a motor temperature of the indoor motor with a target motor speed table.

18. The method of claim 16, wherein the outdoor motor is a variable speed motor, and wherein setting the target speed of the outdoor motor comprises setting the target speed to one of a plurality of speed settings of the outdoor motor.

19. The method of claim 10, wherein the outdoor motor is a single speed motor switchable between an on and an off mode.

* * * * *